US005158286A

United States Patent [19]

Soong

[11] Patent Number: 5,158,286

[45] Date of Patent: Oct. 27, 1992

[54] DAMPING DEVICE FOR SPORTS RACKETS

[76] Inventor: Tsai C. Soong, 1839 Jackson Rd., Penfield, N.Y. 14625

[21] Appl. No.: 309,737

[22] Filed: Mar. 8, 1989

[51] Int. Cl.[5] ..... A63B 51/10

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 2,732,209 | 1/1956 | Forbes | 273/73 D X |
| 4,180,265 | 12/1979 | Staufer | 273/73 D |
| 4,499,144 | 2/1985 | van Rijswijk | 273/73 R X |
| 4,575,083 | 3/1986 | Adam | 273/73 D |
| 4,589,662 | 5/1986 | Robaldo | 273/73 D |
| 4,600,194 | 7/1986 | Donnelly | 273/73 D |
| 4,609,194 | 9/1986 | Krest et al. | 273/73 D |
| 4,634,124 | 1/1987 | Yuhas et al. | 273/73 D |
| 4,732,383 | 3/1988 | Ferrari et al. | 273/73 D |
| 4,765,620 | 8/1988 | Janes | 273/73 G |
| 4,776,590 | 10/1988 | Krest et al. | 273/73 R |
| 4,911,445 | 3/1990 | Ferrari et al. | 273/73 D |

FOREIGN PATENT DOCUMENTS

| | | | |
|---|---|---|---|
| 3123690 | 3/1983 | Fed. Rep. of Germany | 273/73 R |
| 2585256 | 1/1987 | France | 273/73 D |
| 2586936 | 3/1987 | France | 273/73 D |
| 8802271 | 4/1988 | World Int. Prop. O. | 273/73 D |
| 8901809 | 3/1989 | World Int. Prop. O. | 273/73 D |

*Primary Examiner*—Paul E. Shapiro
*Assistant Examiner*—William E. Stoll
*Attorney, Agent, or Firm*—Bernard A. Chiama

[57] ABSTRACT

An improvement for application to the string network of a sports racket is disclosed as being in the form of an elastic band held in moving contact with one or more strings in the network for damping the shock produced on the network by a ball coming in playing contact therewith. The band may take various forms and be held in moving contact by various arrangements. The band may be rectangular, semi-circular or round in cross-section, or may be hollow. For moving with a string, the band may be glued to the same along most of the band or at certain points. In the alternative, the band may be spirally wound around a string to effect a tight fitting contact therewith. Still another alternative is to utilize a hollow band which has been slipped over one or more strings during the stringing of the network. To apply a hollow band after the network has been strung, the band may be slit longitudinally and when slipped over one or more strings. In all of these embodiments, the band must move with the string during shock vibrations in order to be effective.

4 Claims, 5 Drawing Sheets

DAMPING DEVICE FOR SPORTS RACKETS

BACKGROUND OF THE INVENTION

The present invention relates to sports rackets in general, but more specifically to a tennis racket having a hitting area strung with longitudinal and transverse (cross) strings and having a frame surrounding and supporting the string network.

It is well known that when a ball hits the network, shock is introduced through the string network to the frame following the impact. The excitation will terminate after the damping of the material consumes the residual dynamic energy in the string network and the frame.

However, people reasonably familiar with the art often confuse vibration with shock even though these are two opposing dynamic phenomena. Vibration is generally characterized by continuous harmonic or random motion of relatively small acceleration amplitude. On the other hand, shock commonly features a sharp sudden change in velocity or from a static condition due to a sudden acceleration from an abruptly applied force on the structure. When a tennis racket is swung against an incoming ball and returned, the contact lasts a few thousands of a second. The predominating phenomenon is not the velocity of the racket at any point in time, but rather, it is the extremely large velocity change per unit time-acceleration which the player feels. It is the shock passing through the string network.

To reduce shock, the prior art devised means to increase damping and to accelerate the energy consumption. One category of damping devices is the use of viscoelastic material in the form of small ball-like or strip objects attached to the string network which vibrate together with the string and achieve the purpose of hastening the energy consumption. In this category, U.S. Pat. No. 4,180,265 discloses a device inserted between the space provided by two parallel strings and the frame which supports them, wherein the device mechanically interlocks the parallel strings. Another example is disclosed in U.S. Pat. No. 4,776,590, which provides a block comprising two different foam materials inserted between parallel neighboring strings. U.S. Pat. No. 4,609,194 discloses a block of three portions inserted between parallel strings; and U.S. Pat. No. 4,575,083 discloses damping strips which border the edge regions of the hitting area and are sandwiched between perpendicular strings to assure that the strips vibrate together with the vibrating string. There are prior art disclosures of damping devices attached to the frame such as in U.S. Pat. Nos. 4,765,620; 4,600,194 and 4,634,124 which are not directly fastened to the strings, but rather, are attached to frames.

In still other patents in the prior art, use is made of a block of mass, such as rubber, fastened on the network near the frame as a means of damping to suppress the shock. As is commonly known from the theory of vibration, amplitude may be reduced to some extent by having such a device. However, whatever extent of the reduction of amplitude is possible, it is not because the dynamic energy has been consumed, but rather, that the up and down movement of the string has to carry the extra mass up and down also, and consequently, the amplitude has to be reduced. Nevertheless, in this case, the energy is not really consumed, and frequency would remain the same. In time, rubber can experience rapid increase in material stiffness and will quickly lose its ability to absorb amplitude while transmitting. On the other hand, viscoelastic and thermoplastic materials would produce better results in this regard.

Therefore, it is the principal object of the present invention to enhance the capability of a damping device for a sports racket.

Another object of the present invention is to simplify the application of a damping device to a sports racket which will permit variations of the amount of damping to be applied, and which can be readily removed and replaced when worn or broken.

A further object of the present invention is to utilize a damping device for the string network of a sports racket which is capable of assuming a variety of forms and arrangements of applications to the network strings.

Still another object of the invention is to increase the number of points of application of a damping device significantly, thereby increasing the opportunities to select those few strings most responsible for transmitting shock.

The present invention has been devised to overcome the above described deficiencies of the prior art. It comprises an elastic and flexible band made from thermoplastic material attached to one or more strings in the string network of a sports racket. Attachment to the string may be made by adhesive material and relative to a string of the network adjacent only one edge thereof, or nearer to the edge of the racket than its center. For more enhanced damping, the band may be extended to more than one string, or to a string adjacent the head portion of the racket. For maximum damping action, the band may be spirally applied in a complete circuit around the network. The band itself may take different forms and may be wound around a racket string in accordance with one or more different pitches of spiral orientation.

The present invention employs a long piece of elastic and flexible band of suitable cross-sectional shape and material with damping property such as, but not limited to, thermoplastics. The band is wrapped around and along strings characterized so that the band can move together with the string to which it is attached. The wrapping is arranged not just at junction points where longitudinal and lateral strings meet but along the entire length between two adjacent junction points. This continuity in moving together along the length between junction points is made possible by several ways which will be described below. The band is placed along a length of the string or strings adjacent to or at a slight distance from the boundary of the frame.

As distinguished from the prior art, the damping device in the form of a band is continuously attached to the string, relatively inseparable from each other due to wrapping spirally around the string or by gluing to it at certain points. The band bends and stretches together with the string when the latter bends and stretches following the impact of the ball. According to damping theory, this attachment to a string and its ability to bend and stretch are very important for a viscoelastic material to consume the dynamic energy of the vibrating string. The band is thin and is not obstructive; consequently, it does not add significantly either in weight or in air resistance even if it is used extensively lengthwise around the boundary of the frame. Damping can be achieved by placing the band on a few of the selected strings near the frame, or along the complete inner circumference of the frame to isolate the playing area of the string network from transmitting shock to the frame in any direction.

Other objects and advantages will become apparent after reviewing the following descriptions taken in conjunction with the drawings wherein:

FIGS. *7a* and *7b* are schematic views of different applications of a band to a racket; and FIGS. *8a*, *8b* and *8c* are acceleration-time curves of the results of actual play and laboratory tests of the impact of a ball on a string network.

Description of a Preferred Embodiment

Figure 1:
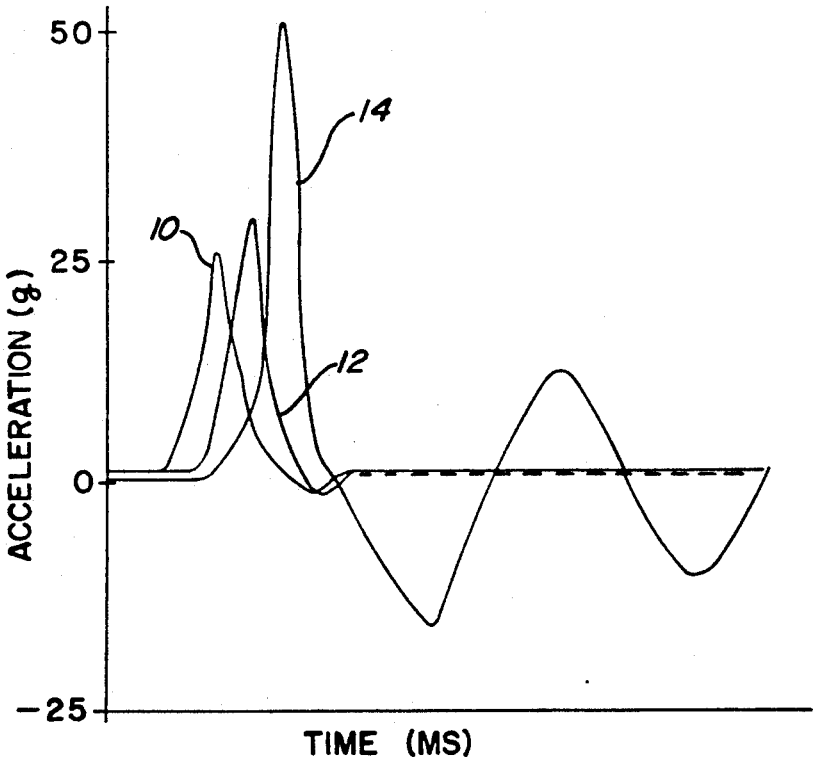
FIG. 1 illustrates a series of curves produced by the shock response, measured in acceleration, of a machine isolated by grommets made of Neoprene material and also of thermoplastic material.
Figure 2:
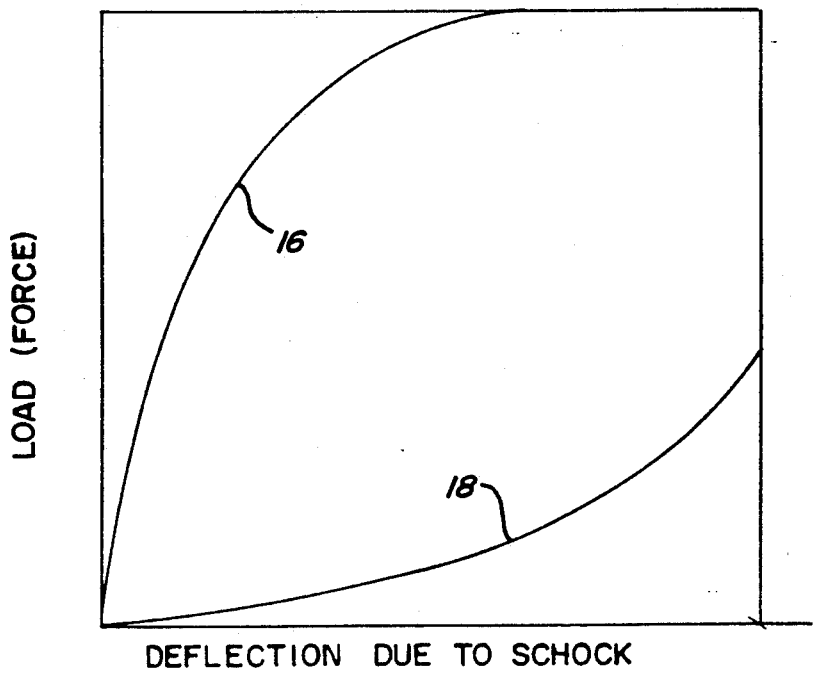
FIG. 2 illustrates a series of curves of resultant energy absorbed by a damping device made of thermoplastic and rubber as deflection of damping progresses.

In the time versus acceleration curves of FIG. 1, the application of a shock to a string network, illustrated by the curve 10, is shown in relation to the resultant effects of the shock upon a rubber damper, illustrated by the curve 12 and upon a thermoplastic damper, illustrated by the curve 14. As the shock is applied, the rubber damper has a very slowly damped motion with time and even amplifies the amplitude initially, whereas the thermoplastic damper quickly brings the system to equilibrium. From point of view of energy consumption, the curves of FIG. 2 show that the thermoplastic damper, as exemplified by the curve 16, consumes a large amount of dynamic energy as it moves along with time and that the rubber damper, as illustrated by the curve 18, consumes very little energy as a time function. This demonstrates the point that a damping device attached to a string should not just "move together" with the string as accomplished by those devices in the prior art, but rather, as the device itself has to be "deformed" while moving with the string in order to be effective. In this form of deformation, a thermoplastic material functions as a spring-dash pot device and distinguishes itself from a lesser material, such as rubber, which functions as an elastic spring.

It will also be noted that unless a damping device is a one dimensional structure and its nodes of a sinusoidal motion introduced by a shock is well known, such as a rod or a spring, a damping device arranged on a point on a two-dimensional surface will not be very effective in suppressing shock to the frame which surrounds the surface. A simple demonstration of this phenomenon can be made with respect to the effect of vibrational modes and resonance when a circular drum covered by a tightly stretched membrane experiences a high frequency sustained vibration. If this vibration is introduced at the center of the drum and a thin layer of sand is spread over the surface of the drum, the sand particles will dance and then quickly line themselves up as circular rings. They will become stationary, nodal circles of the vibration mode. When the plane form of the circular drum is changed into an elliptical surface, the circles also line up as concentric elliptical rings. However, when the surface tension which is pulling the membrane tight over the drum's boundary is made to be varying irregularly around the circumference, pulling with different force at different radial directions, the sand particles will jump randomly and refuse to line up along any visible nodal pattern.

If one recognizes the oval drum surface as the string network area of a racket and the random membrane tension pattern as the string tension distribution caused by a shock from the impact of a ball, one would immediately recognize the difficulty of selecting a permanent, most effective site far away from the stationary nodes for a damping device to be applied and to be effective at all times to suppress the anticipated shock. For that reason, a localized damping device in the form of a damping block or a strip clamped to the string at a point near the frame, as suggested in the prior art, would not be significantly effective in its application for shock absorption of rackets. It will be apparent, then, that an effective damping device on rackets must extend over a longer length along a boundary in reference to the circumference of the frame in order to be effective. A single body or a short strip on a fixed site in relation to the frame, clamped on a string, examples of which are disclosed in the prior art, are not capable of producing effective damping. Most of prior art applications failed to observe the two important facts described above.

Figure 3:
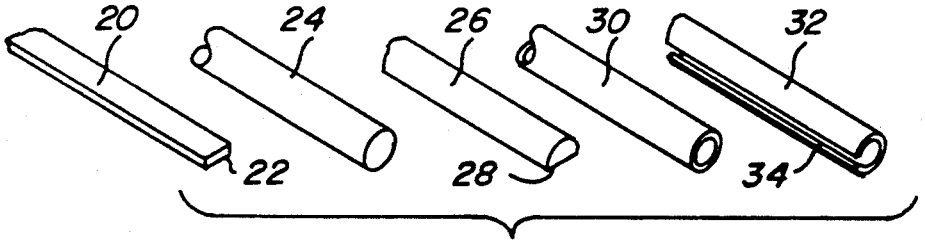
FIG. 3 shows fragmentary views, in cross-section, of various forms of a damping device utilized in the present invention.

The band may assume many cross-sectional shapes, the preferred shapes being shown in FIG. 3. A rectangular cross-sectional shape is exemplified by the band 20 which has one of its flat surfaces 22 adapted for the application of adhesive material thereon and contacting a string. The damping device may also assume a circular cross-section, such as the band 24 or a semi-circular cross-section, such as the band 26. The latter band is formed with a flat surface 28 to which adhesive material may be applied for contacting and adhering to a string.

The damping device may also be of hollow tubular form such as exemplified by the bands 30 and 32, both of which would be arranged with a string extending therethrough. In the case of the band 30, the inside diameter has a dimension so as to permit a snug fit around the string. This form of band is mounted on a string by slipping the same on a string during the stringing step for the sports racket. In the case of the band 32, the wall for this form is sliced open at 34 along the axis thereof to permit wrapping over a string.

Figure 4:
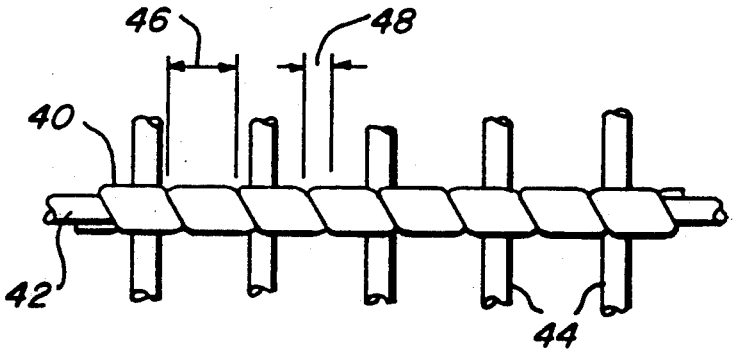
FIGS. 4, 5 and 6 are fragmentary views of network strings and some possible ways of attaching a band to a string.
Figure 5:
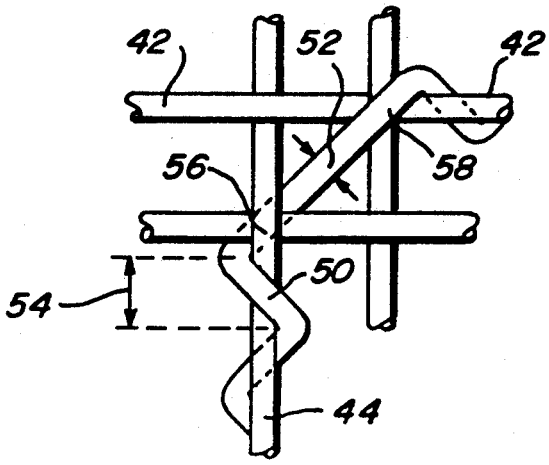
Figure 6:
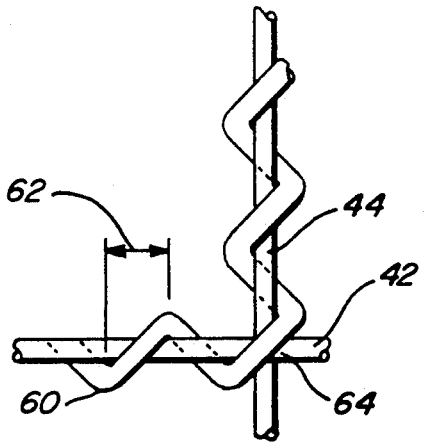

Various examples for attaching a band to one or more strings of a sports racket are illustrated in FIGS. 4–6. In these arrangements, the band is spirally wrapped around the circumference of a string, and preferably for more efficiency, at different pitch lengths. In the event the pitch length is small, a longer band to wrap a predetermined length of the string is necessary.

In FIG. 4, the band 40, which may have a cross-sectional shape similar to bands 20 or 26, is spirally wrapped around a transverse string 42 of a sports racket which also includes longitudinal strings 44. In this example, the width 46 of the band 40 is wide and the pitch length for the wrapping spiral, indicated by the numeral 48, is relatively small. In this arrangement, with the pitch being short, a much longer band 40 is necessary for providing sufficient coverage of a string to effect good damping.

In FIG. 5, a band 50 of circular cross-section, having a diameter indicated at 52, is shown applied to the longitudinal string 44. After a few wrappings around this string with a pitch indicated at 54, the band jumps from the junction 56 of the string 44 with the transverse string 42, to the junction 58 and continues its application to the string network along the transverse string 42. In this arrangement, the string 50 follows two paths perpendicular to each other.

In FIG. 6, the band 60 is wrapped around spirally on the transverse string 42 with a pitch indicated at 62, and upon reaching the junction 64, formed by the string 42, and the longitudinal string 44, is turned to follow the string 44 in similarly wrapped orientation. As previously stated, adhesive material such as glue may be used to firmly attach a band to a string instead of relying upon the tight contact which is also provided when a band is wrapped around a string. It is preferred that the arrangement wherein the band will turn in perpendicular paths, such as illustrated in FIG. 6, that glue be applied to the band at its contact with the strings.

A damping device in the form of band 70, as contemplated in the present invention, is shown in FIG. 7 applied to the string network 72 of the frame 74 of a tennis racket. The frame 74, including the throat section 76, a head 78 and sides 80, 82, provides a complete boundary for the string network 72. In tracing the application of the damping device 70, the same follows the longitudinal string 84 adjacent the side 80, then changes direction to follow the transverse string 86 adjacent the head 78 of the frame, changes direction again to follow a longitudinal string 88 adjacent to side 82, changes direction again to transverse string 90 adjacent the throat 76 and, finally, completes its closed loop by being connected to the starting end on the string 84. The ends of the band 70 may be fastened together or to adjacent strings. In any event, the closed path of the band contains shock produced by the impact of a ball within the area bounded by the endless band.

Figure 7A:
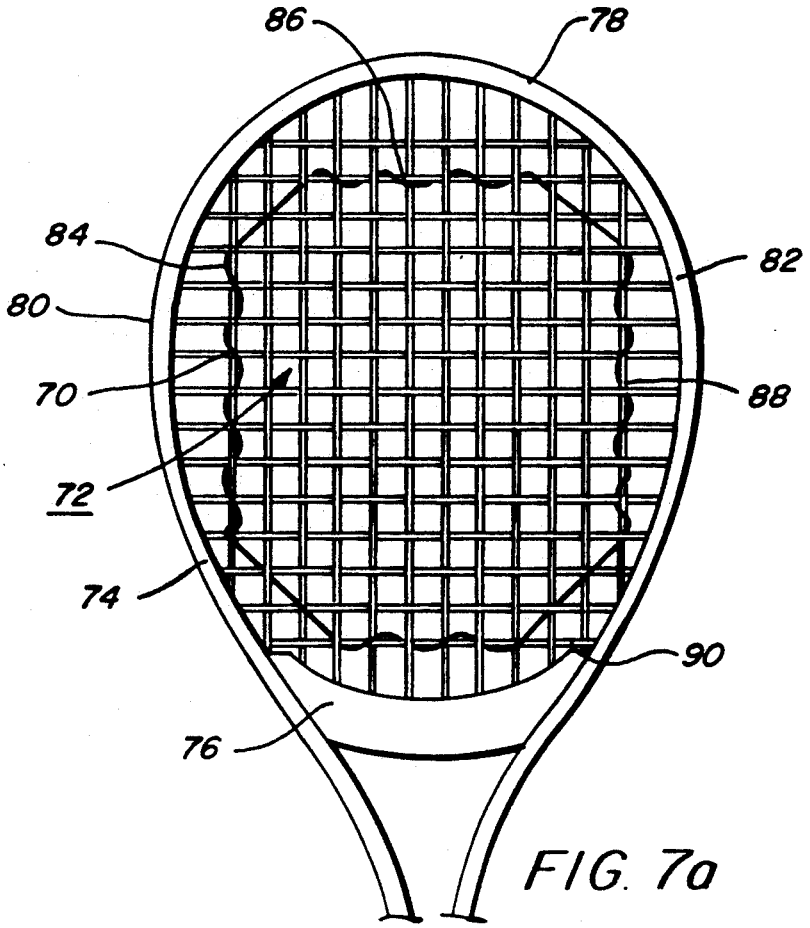

While it is not necessary to spirally wrap a band along the straight portions of the strings 84, 86, 88 and 90, it is preferred that such complete winding be made in order to increase contact with the strings. In changing direction from one string to another, either of the arrangements illustrated in FIGS. 5 and 6 may be employed. The application of the band 70 as a closed loop in FIG. 7*a* provides the optimum damping effect for the racket. However, a partial covering of the complete boundary may also be employed. For example, a band may be wrapped around only the string 86 to prevent the effects of shock in rackets whose design reveals vibration at the head frame.

The hollow bands 30 and 32 may also be applied to the network 72 of the racket illustrated in FIG. 7*a*. The hollow band 30 would have been slipped over a string, say 86, during the stringing of the racket, while the band 32 may be opened at the slit 34 and wrapped around either or both of the strings 84 or 86. In either case, the band will be tightly applied to a string and held in place by the multiple perpendicular strings crossing the string 86. The band will bend and deform tightly with the string 86 and dampen out the amplitude along the same and cross strings that pass therethrough. The advantage of the use of bands 30 and 32 is that their weight can be optimally managed by varying their diameters and lengths, and the tightness of their contact with strings can be controlled.

Another advantage damping devices in the form of a band contemplated by the present invention may provide is that the damping effect can be very simply varied as the need arises. This may be accomplished by the variation of the pitch lengths utilized. For example, if more damping is needed at the edge of the network 72 adjacent the head 78 than at the sides 80, 82, the short pitch length 48 of FIG. 4 may be utilized when the band 70 is applied to the string 86. On the other hand, a larger pitch length, such as that illustrated at 54 in FIG. 5, may be utilized for the strings 84, 88 and 90.

In the use of damping devices, it must be remembered that damping is a means to reduce shock. However, damping also consumes kinetic energy coming from an incoming ball. A truly efficient damping device placed at the center of a string network would completely consume the ball's energy resulting in the ball's being dropped "dead." Actual play testing has shown that the above described damping device reduces shock effectively while still maintaining sufficient power, control and liveliness of play when it is applied as a complete closed loop, suitable weight per unit length, roughly in parallel, but at a small distance from the inner circumference of the racket frame. Since more damping material is more effective in suppressing shock, and since players vary in preference to racket weight and balance, there is no universal "weight limit" or "exact" location for a damping device.

However, some examples of weight and location have been devised and considered as guides for optimal parameters:

1. For rackets with 17 (1.14 mm) to 15 (1.45 mm) gauges of length from string, a viscoelastic band should have a preferred range of 0.035 to 0.18 gm per cm, if the band completely encircles the central part of the string network. It has been found that with less than 0.035 gm per cm, the benefit is not significant, and if greater than 0.18, too much kinetic energy is consumed, and the play loses dynamism. If the band only partially or intermittently encircles the circumference, the upper range of 0.18 gm per cm may be increased.

2. If the band covers only the top or the bottom width of the frame, the preferred range is 0.013 to 0.67 gm per cm wherein the wrapped length of the transverse string is 15 cm. For lengths less than that, the upper range of 0.67 gm per cm may be increased.

It has also been found that for the same weight per unit length, two smaller bands spirally wrapped, one clockwise and the other counter clockwise on top of each other and over the string, is more effective than a larger band spiralled only in one direction. This will be obvious because in the former case, the bands will move tightly together and with the string, whereas in the latter case, the band and string will not adhere to each other as tightly.

In another embodiment, the split tube configuration 32 may be cut into short lengths, each fitting onto the length between two adjacent perpendicular strings. This may be done after the frame is completely strung. In such an arrangement, the number of short bands used in the damping arrangement may be arbitrary to suit weight and vibration considerations.

In the embodiments described in the foregoing, whenever applicable, the band is tensioned snugly while being wrapped around a string. The band may have glue on surfaces 22 and 28, or in the inside surface of a split tubular section, when contacting the string. This provides a tight bonded interface between the band and the string.

Figure 8A:
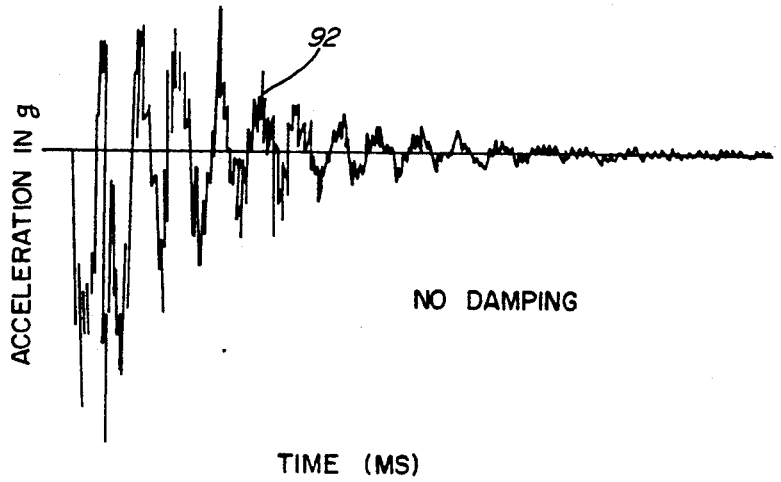
Figure 8B:
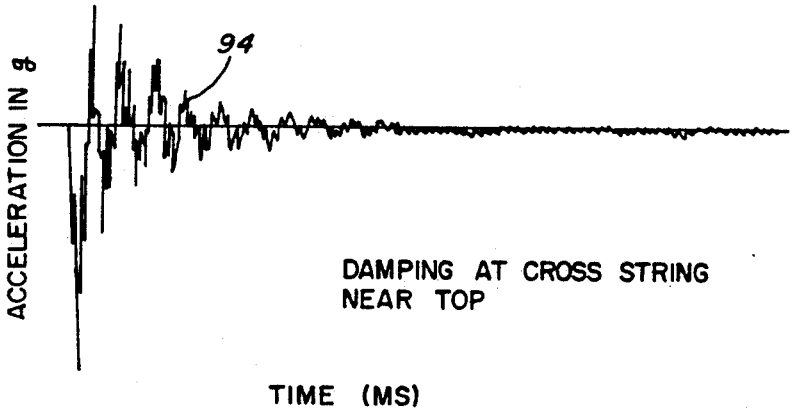
Figure 8C:
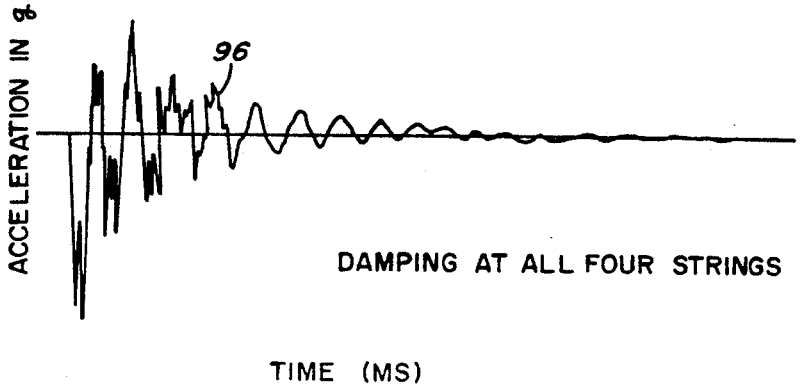

The series of time versus acceleration curves illustrated in FIGS. 8*a*, 8*b* and 8*c* depict the results of actual play tests and laboratory tests conducted on a conventional tennis racket. In these tests, a load-cell of accelerometer measuring transient acceleration at a point was mounted at the handle 18 cm from the end of the handle, and an impact by a ball was imposed upon the center of the network. FIG. 8*a* depicts a sinusoidal shock wave pattern 92 produced by a typical impact on the center of an undamped string network by a tennis ball. It will be noted that the curve 92 is multi-spiked with random points of acceleration typical of impact resulting from a varied, unfiltered shock source. It was noted that the noticeable vibration was effected at the head region of the racket.

In the laboratory, tests of a single piece of band attached near the top of the same racket frame at a transverse string, such as the string 86 in FIG. 7*a*, produced results illustrated by the curve 94 in FIG. 8*b*. The band was a thermoplastic strip (E.A.R.C-1002) spirally wrapped around that top cross string. The band was 1.5 mm thick, 5.0 mm wide, 20 cm long and weighed 2.0 gm. It will be noted that the curve 94 is indicative of damped vibration with reduced amplitude and damped monotonously with time when compared to the results indicated by the curve 92. The single damping band eliminated high pitched sounds and reduced vibration considerably.

The curve 96 of FIG. 8*c* was produced by a band spirally wound along the four sides of a racket frame as illustrated in FIG. 7*a*. The racket in play was exceptionally quiet and smooth and was more effective in damping than the singly applied band which produced the curve 94. This band was 68 cm long and weighed 7.5 gm with the weight of the racket being 350 gm. It will benoted that the curve 96 depicts a smoothly "filtered" damped vibration with a clear single harmonic wave motion. This may explain the solid smooth feel of the playing characteristics of the racket with the band completely encircling the playing area of the string network.

Figure 7B:
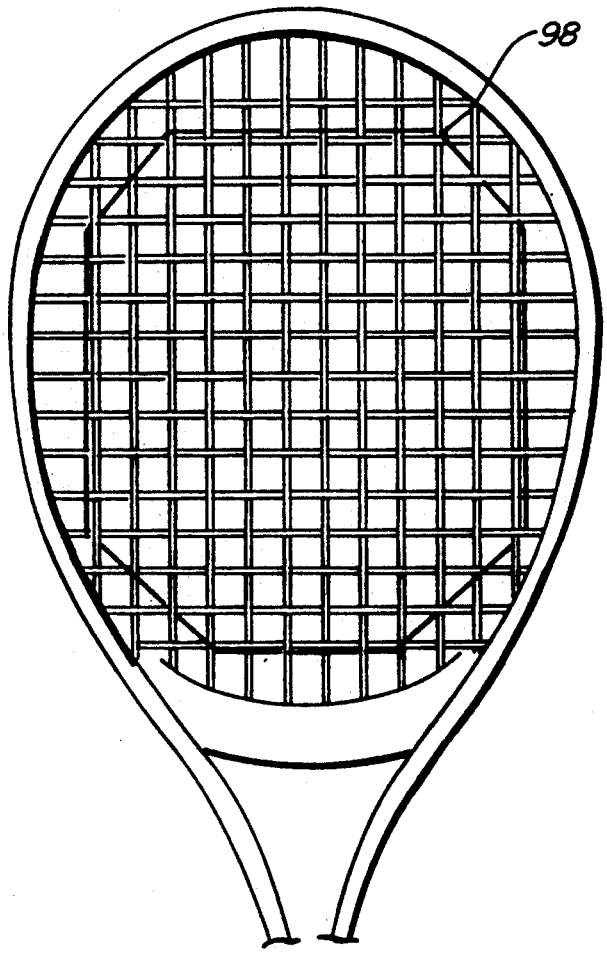

Another embodiment of applying a band to a string network is shown in FIG. 7*b* wherein the band 98 runs parallel to one or more strings and extends beneath and over neighboring perpendicular strings for support and attachment for damping purposes. If need be, the band 98 may be glued to one or more strings and/or at junction points of the string, so that, as in all of the previously described embodiments regarding movement with a string to which it is associated, there is continuity in moving together along the length between junction points.

While in the foregoing various embodiments of the invention have been disclosed in considerable detail, it will be understood that these were only for illustration purposes and that modifications of the above modes of carrying out the invention, which are obvious to those of skill in the art of sports racket design or related fields, are intended to be within the scope of the following claims.

What is claimed is:

1. A sports racket having a frame surrounding a string network of crossing longitudinal and transverse strings, the frame being formed with a head portion, a throat portion and two opposed side portions joining the head and throat portions, the improvement comprising damping means associated with at least one of the strings adjacent at least one of the portions of the frame for damping vibrations induced in said at least one string resulting from the impact of a ball against the network, said damping means including an elastic band arranged in continuous contact with and extending along to follow said at least one string to be movable therewith during vibration thereof, said elastic band having two end portions each of which being attached to said at least one string.

2. A sports racket as defined in claim 1 wherein said band is in contact with one of the longitudinal strings adjacent said at least one portion of the frame and is similarly in contact with at least one transverse string adjacent another portion of the frame.

3. A sports racket as defined in claim 1 wherein said at least one string is one of the transverse string of the network adjacent the head portion of the

4.A sports racket as defined in claim 1 wherein said band is in contact with at least one of the longitudinal and transverse strings adjacent the side, the head and the throat portions of the frame.

* * * * *